US010053319B2

(12) United States Patent
Oguchi

(10) Patent No.: US 10,053,319 B2
(45) Date of Patent: Aug. 21, 2018

(54) CARD CONVEYANCE SYSTEM AND CARD CONVEYANCE CONTROL METHOD

(71) Applicant: NIDEC SANKYO CORPORATION, Suwa-gun, Nagano (JP)

(72) Inventor: Yosuke Oguchi, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 40 days.

(21) Appl. No.: 15/205,405

(22) Filed: Jul. 8, 2016

(65) Prior Publication Data

US 2017/0008717 A1 Jan. 12, 2017

(30) Foreign Application Priority Data

Jul. 10, 2015 (JP) ..... 2015-138633

(51) Int. Cl.
*B65H 7/20* (2006.01)
*G07F 19/00* (2006.01)

(52) U.S. Cl.
CPC ..... *B65H 7/20* (2013.01); *G07F 19/20* (2013.01); *B65H 2301/4474* (2013.01); *B65H 2511/414* (2013.01); *B65H 2513/108* (2013.01); *B65H 2701/1914* (2013.01)

(58) Field of Classification Search
CPC ..... B65H 7/20; B65H 2511/414; B65H 2301/4474; B65H 2701/1914; B65H 2513/108; G07F 19/20; G06F 13/42
See application file for complete search history.

(56) References Cited

U.S. PATENT DOCUMENTS 6,370,447 B1 * 4/2002 Miyazaki ..... B65G 43/10 198/349.8
6,598,869 B2 * 7/2003 Johnson ..... B65H 5/062 271/265.02
7,588,182 B2 * 9/2009 Carpenter ..... G06Q 20/042 235/379
7,657,473 B1 * 2/2010 Meffie ..... G06Q 20/042 235/379
8,893,962 B2 * 11/2014 Ma ..... G07F 19/207 235/379

(Continued)

FOREIGN PATENT DOCUMENTS

JP 2009086832 A 4/2009

*Primary Examiner* — Ernesto A Suarez
(74) *Attorney, Agent, or Firm* — Cantor Colburn LLP

(57) ABSTRACT

A card conveyance system may include a first device; a second device; a conveying passage; and a host apparatus controlling the first and second device. The first device may send a card to and receive the card from the second device via the conveying passage. The second device may receive the card from and send the card to the first device via the conveying passage. The host apparatus may include an application executing section to execute an application including a user interface; a middleware executing section to execute middleware controlling the second device and the first device corresponding to a command of a standard specification; and a synchronous control section configured to acquire a command of the standard specification and control a conveying roller of the first device and a conveying roller of the second device synchronously with conveyance of the card.

13 Claims, 9 Drawing Sheets

(56) References Cited

U.S. PATENT DOCUMENTS

2002/0152165 A1* 10/2002 Dutta ..... G06Q 20/04
705/43
2006/0069828 A1* 3/2006 Goldsmith ..... G06F 13/382
710/100

* cited by examiner

CARD CONVEYANCE SYSTEM AND CARD CONVEYANCE CONTROL METHOD

CROSS REFERENCE TO RELATED APPLICATION

The present invention claims priority under 35 U.S.C. § 119 to Japanese Application No. 2015-138633 filed Jul. 10, 2015, the entire content of which is incorporated herein by reference.

FIELD OF THE INVENTION

At least an embodiment of the present invention may relate to a card conveyance system and a card conveyance control method. Especially, at least an embodiment of the present invention may relate to a card conveyance system and a card conveyance control method in which a card is conveyed along a conveying passage between a sending side and a receiving side.

BACKGROUND

A conventional ATM (Automated Teller Machine) or the like incorporates with a device referred to as a card reader in which reading and writing in a magnetic card or an IC card are performed. The card reader may be connected with a card collection and return module in which a card having been forgotten to take out by a user is collected and returned. Further, the card reader may be connected with a device such as an image reader or a card printer other than a card collection and return module. A card can be conveyed between two devices connected with each other through a conveying passage.

The two devices are commonly controlled by a host apparatus such as a built-in PC (Embedded Personal Computer). The host apparatus controls the two devices by executing control programs corresponding to the respective devices. In this case, an application providing a user interface or the like of an ATM uses an API (Application Programming Interface) which is capable of issuing a command of a standard specification. Therefore, even when either of the devices is changed, a common application can be utilized by only changing a device driver or a registry which directly controls the device. An example in which such two devices are controlled is described in Japanese Patent Laid-Open No. 2009-86832.

An example like a technique described in the above-mentioned Patent Literature of a card conveyance system 3 provided with two devices will be described below with reference to FIG. 9. The card conveyance system 3 shows a structural example in which a card collection and return module 20 is connected with an ATM incorporating with a card reader 10 which has been used in a market. When a card 40 is to be collected, the card 40 in the card reader 10 is required to be conveyed to the card collection and return module 20 between the card reader 10 and the card collection and return module 20. Further, on the contrary, a card 40 may be required to be conveyed from the card collection and return module 20 to the card reader 10. In a case of an object in a control program of a middleware, for example, in a case of OS (Operating System) of Windows (registered trademark) series, control of the conveyance can be realized by executing a service provider (hereinafter, referred to as an "SP") corresponding to each device. However, when a card 40 is conveyed between two devices, there may occur a problem that the card 40 is not normally delivered between two devices by control of an "SP" of each device. A specific example will be described below.

In FIG. 9, the host apparatus 33 includes, as functional blocks, an application executing section 110 configured to execute an application for finance and a middleware executing section 123 configured to execute an API corresponding to a command of standard of CEN/XFS (Comite Europeen de Normalisation/eXtensions for Financial Services) which is a standard in an application for finance. The middleware executing section 123 includes a card reader class SP 213 corresponding to control of the card reader 10 and a card collection and return module class SP 223 corresponding to control of the card collection and return module 20. This is because that, when mounting is performed according to the API of the CEN/XFS standard like this example, the SPs respectively corresponding to the card reader 10 and the card collection and return module 20 are required to provide. Further, the card reader class SP 213 and the card collection and return module class SP 223 are respectively provided with DLLs 510 and 520 (Dynamic Link Library) for execution which are configured to execute different device drivers or the like.

In this example, the card reader class SP 213 corresponding to the CEN/XFS standard does not prepare a command that a card 40 is taken in from a rear side. Therefore, the host application executing section 110 is unable to send a command to the card reader 10 for taking in a card 40 from a rear side. Accordingly, a card 40 conveyed from the card collection and return module 20 is stopped in a state that the card 40 has been pushed into a rearward insertion port of the card reader 10. On the other hand, the card reader class SP 213 is provided with a reset command for resetting the card reader 10 and an ejection command for ejecting a card 40 existed in an inside of the card reader 10 to a gate insertion port. Therefore, the card 40 having been pushed into the rear side of the card reader 10 from the card collection and return module 20 is ejected to the gate port where the card 40 is to be inserted by a user by using these commands and the card is returned to the user.

However, when a card 40 is conveyed according to the above-mentioned method, the card 40 is unable to be smoothly conveyed between the two devices. Therefore, the conveying roller 11 located on a rear side of the card reader 10 and the conveying roller 21 which is used in the card collection and return module 20 for ejecting the card 40 are remarkably deteriorated. This problem occurs similarly when a card 40 is conveyed in the opposite direction, in other words, when a card 40 is conveyed from the card reader 10 to the card collection and return module 20.

SUMMARY

In view of the problem described above, at least an embodiment of the present invention may advantageously provide a card conveyance system and a card conveyance control method which are capable of eliminating the problem and are capable of conveying a card smoothly.

According to at least an embodiment of the present invention, there may be provided a card conveyance system including a sending side device which is capable of sending a card along a conveying passage, a receiving side device which is capable of receiving the card from the sending side device along the conveying passage, and a host apparatus which controls the sending side device and the receiving side device. The sending side device and the receiving side device are respectively capable of functioning as the receiving side device and the sending side device. The host apparatus includes an application executing section which executes an application including a user interface, a middleware executing section which executes middleware controlling the receiving side device and the sending side device corresponding to a command of a standard specification from the application executing section, and a synchronous control section which acquires a command of the standard specification acquired from the application executing section by the middleware executing section and controls a conveying roller of the sending side device and a conveying roller of the receiving side device synchronously with conveyance of the card as necessary. According to this structure, the two devices which are the sending side device and the receiving side device can be controlled while the command is related and thus sending and receiving of a card can be smoothly performed between the two devices.

In the card conveyance system in at least an embodiment of the present invention, the synchronous control section includes a shared object server which transmits commands to the sending side device and the receiving side device. According to this structure, control can be requested from the shared object server to the sending side device and the receiving side device.

In the card conveyance system in at least an embodiment of the present invention, the middleware executing section controls the sending side device and/or the receiving side device by a service of OS, and the synchronous control section transmits a command to the sending side device and/or the receiving side device controlled by the service through inter-process communication of OS. According to this structure, control can be requested to the sending side device and the receiving side device also from an application executed in a different process by a service of OS or the like.

In the card conveyance system in at least an embodiment of the present invention, the synchronous control section drives the conveying roller of the receiving side device at an equal or higher speed than the conveying roller of the sending side device. According to this structure, a card can be driven smoothly.

In the card conveyance system in at least an embodiment of the present invention, the synchronous control section starts driving of the conveying roller of the receiving side device before driving start of the conveying roller of the sending side device. According to this structure, a card can be conveyed smoothly.

In the card conveyance system in at least an embodiment of the present invention, the synchronous control section transmits a command to the receiving side device for driving the conveying roller at an earlier timing than driving start of the conveying roller of the sending side device. According to this structure, a card can be conveyed smoothly.

In the card conveyance system in at least an embodiment of the present invention, the synchronous control section transmits commands for simultaneously driving the conveying roller of the sending side device and the conveying roller of the receiving side device, and the command transmitted to the conveying roller of the sending side device includes a delay time command which delays start of driving for a predetermined time. According to this structure, a card can be conveyed smoothly.

In the card conveyance system in at least an embodiment of the present invention, the sending side device and the receiving side device are respectively one of a card reader structured to contact with the card for reading and writing information, a non-contact IC card reader structured to read and write information in the card in a non-contact state, a card collection and return module structured to collect and return the card, an image reader structured to optically read the card, and a printer structured to print on the card. According to this structure, a card can be controlled to be conveyed smoothly in the above-mentioned various devices.

According to at least an embodiment of the present invention, there may be provided a card conveyance control method for a card conveyance system having a sending side device which is capable of sending a card along a conveying passage, a receiving side device which is capable of receiving the card from the sending side device along the conveying passage, and a host apparatus which controls the sending side device and the receiving side device. The card conveyance control method includes previously providing the sending side device and the receiving side device being respectively capable of functioning as the receiving side device and the sending side device, executing an application including a user interface, executing middleware controlling the receiving side device and the sending side device corresponding to a command of a standard specification of the application being executed, acquiring the command of the standard specification at a time of executing the middleware, and controlling a conveying roller of the sending side device and a conveying roller of the receiving side device synchronously with conveyance of the card as necessary. According to this method, the two devices which are the sending side device and the receiving side device can be controlled while the command is related and thus sending and receiving of a card can be smoothly performed between the two devices.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF EMBODIMENTS

Embodiments

[Structure of Card Conveyance System 1]

Figure 1:
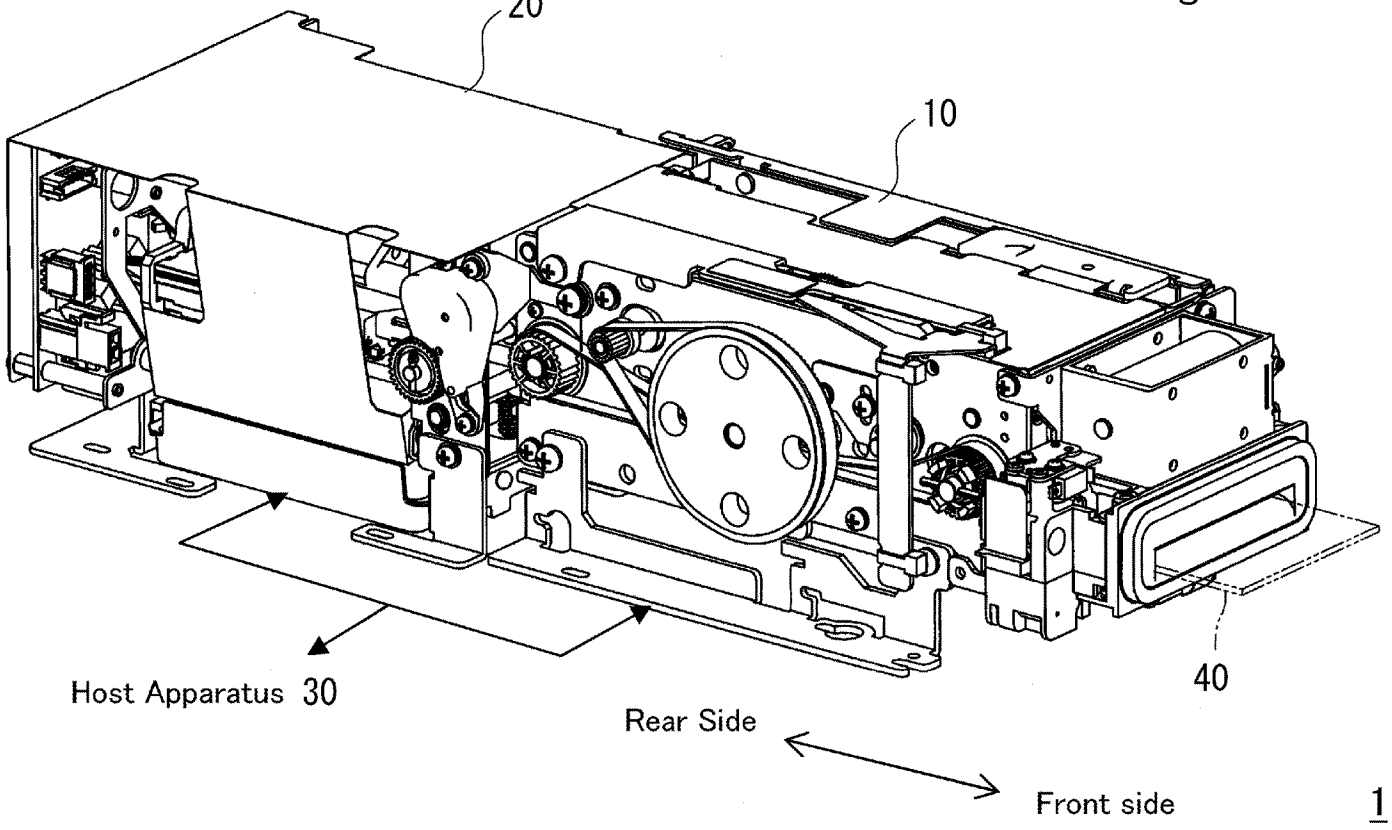
FIG. 1 is a perspective view showing an outward appearance of a card reader and a card collection and return module of a card conveyance system in accordance with an embodiment of the present invention.

An example of a schematic structure of a card conveyance system 1 in accordance with an embodiment of the present invention will be described below with reference to FIGS. 1 and 2.

In this embodiment, a card conveyance system 1 is an ATM, a terminal of a kiosk, a ticket issuing system of means of transportation, a point card issuing system of a convenience store, a member card issuing system of a retail store, a card issuing/payment system of an amusement machine, an entrance and exit management system, and the like which are provided with a function structured to return a card left untaken (hereinafter, simply referred to as "ATM"). In a card conveyance system 1 in this embodiment, two devices of a sending side device and a receiving side device where a card 40 is conveyed are controlled by a host apparatus 30. Further, the two devices also function as a receiving side device and a sending side device respectively. In this embodiment, as an example, a card reader 10 and a card collection and return module 20 are used as the two devices. In this embodiment, the devices are capable of connecting with each other through a signal of USB (Universal Serial Bus) standard or the like. In accordance with an embodiment of the present invention, it may be structured that two USB cables of the devices are connected to a USB hub and the devices are connected with the host apparatus 30 through the USB hub. Further, at least an embodiment of the present invention may be also applied to two devices where a card 40 can be conveyed therebetween. For example, a conveyance method of the card conveyance system 1 in this embodiment may be similarly applied to a non-contact type IC card reader structured to read or write information in a card 40 in a non-contact state, an image reader (scanner) structured to optically read a picture or characters on a surface of a card 40, a printer structured to print on a card 40, a shredder structured to shred a collected card 40, or the like.

First, an outward appearance structure of a card reader 10 and a card collection and return module 20 of a card conveyance system 1 will be described below with reference to FIG. 1. The card reader 10 is a motor conveyance type card reader/writer device in which information of a card 40 is capable of being read and written. The card reader 10 includes a conveying mechanism structured to convey a card 40, a connection part such as IC contact points, an electromagnetic induction antenna and the like for reading and writing an IC card, a magnetic head configured to read information stored in a magnetic stripe or write it in the magnetic stripe, and the like. Further, the card reader 10 is also capable of ciphering and deciphering information that is to be read or written. The card reader 10 is, for example, connected with the host apparatus 30 via a USB connection.

Figure 2:
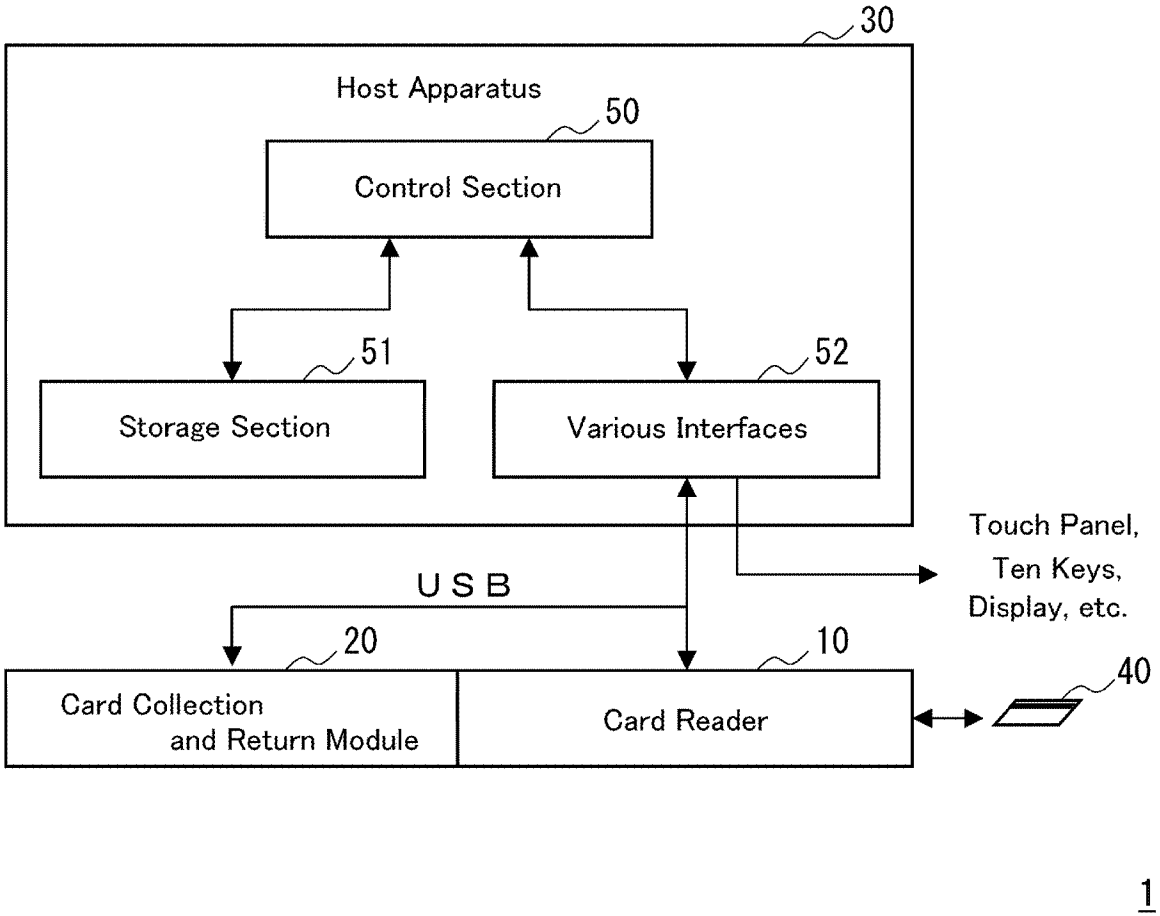
FIG. 2 is a block diagram showing a system structure of a card conveyance system in accordance with an embodiment of the present invention.

The card reader 10 takes a card 40 from a front side to an inner side or a rear side in FIG. 1. The card reader 10 performs reading and writing data from and in an IC and a magnetic stripe. When the processing is finished, the card reader 10 conveys the card 40 to a front side and ejects it and the card 40 is returned to a user. Further, in a case that a user has forgotten the card 40 to take out or, in a case that a fraudulent card 40 is used, the card reader 10 conveys the card 40 to a rear side and sends it to the card collection and return module 20. Therefore, a conveying roller 11 (see FIG. 3) for conveying the card 40 is provided on a rear side of the card reader 10. Further, the card reader 10 includes a gate insertion port where a card 40 is taken from the outside of the device and is ejected to the outside, and sensors configured to detect the card 40 having been taken into its inside. Further, in a case that a card 40 accommodated in the card collection and return module 20 is to be returned to the user who has forgotten to take out, the card reader 10 drives the conveying roller 11 for conveying the card 40 to a front side. As a result, the card reader 10 receives the card 40 from the card collection and return module 20 and conveys it to the front side and ejects it.

The card collection and return module 20 is a device structured to receive and accommodate a card 40 which is sent from the card reader 10, or to send an accommodated card 40 toward the card reader 10. Therefore, the card collection and return module 20 is provided with a card accommodation part 22 (see FIG. 3) having slots where a plurality of cards 40 can be inserted in its inside. The card accommodation part 22 performs a lifting and lowering operation corresponding to a command from the host apparatus 30. Therefore, each of slot positions can be coincided with the height of a conveyance port on a rear side of the card reader 10. A state whether a card 40 is accommodated in each of the slots or not is capable of being confirmed by a command corresponding to a state notifying command. Further, a conveying roller 21 (see FIG. 3) for conveying a card 40 is provided to a front side of the card accommodation part 22 of the card collection and return module 20. Therefore, a card 40 sent from the card reader 10 can be taken into an inside of the slot from a front side. Further, a card 40 accommodated in the slot is pushed to the conveying roller 21 on a front side by a lever mechanism for pushing the card 40 and is conveyed by the conveying roller 21, and the card 40 is further sent toward the card reader 10 on the front side.

The card collection and return module 20 is capable of dropping and collecting a card 40, which exceeds an accommodation number of cards, in a collection box 23 (see FIG. 3) provided under the slots. In this case, the card accommodation part 22 is controlled so as to lift up to the uppermost position (home position). When the card accommodation part 22 is located at the uppermost position, a card 40 conveyed from the front side is not conveyed to a slot of the card accommodation part 22 and is dropped and collected in the collection box 23. The card 40 collected in the collection box 23 is taken out and stored by a manager of the ATM or the like. Further, the card collection and return module 20 is, similarly to the card reader 10, also connected with the host apparatus 30 via a USB connection. In accordance with an embodiment of the present invention, the card collection and return module 20 may be provided with a card hopper in which unused cards 40 are stored.

In a case that a card 40 which is left without being taken by a user is to be collected, the card reader 10 and the card collection and return module 20 respectively function as a sending side device structured to send the card 40 along the conveying passage and a receiving side device structured to receive the card 40 from the sending side device along the conveying passage. Further, when a card 40 accommodated in the card collection and return module 20 is to be returned to a user, the card reader 10 and the card collection and return module 20 respectively function as a receiving side device and a sending side device.

A card 40 is a contact type or a non-contact type IC card 40 and/or a magnetic card having a magnetic stripe in which magnetic recording is capable of being performed. The card 40 is, for example, a rectangular card made of vinyl chloride whose thickness is about 0.7-0.8 mm. The card 40 is, for example, formed with a magnetic stripe in which magnetic data are recorded. Further, for example, an IC chip is incorporated into the card 40. The card 40 may be provided with both of an IC and a magnetic stripe. In accordance with an embodiment of the present invention, the card 40 may be a PET (polyethylene terephthalate) card whose thickness is about 0.18-0.36 mm or a paper card having a predetermined thickness. Information of a user, monetary value information and the like are stored in the card 40 so as to correspond to functions of applications executed in the host apparatus 30 described below.

Next, a system structure of the host apparatus 30 of the card conveyance system 1 will be described below with reference to FIG. 2. As described above, in this embodiment, the host apparatus 30 of the card conveyance system 1 is connected with the card reader 10 and the card collection and return module 20.

The host apparatus 30 is a built-in PC (Embedded Personal Computer), an FC (Factory Computer), a server or the like for an ATM or the like. The host apparatus 30 includes a control section 50, a storage section 51, various interfaces 52 and the like and controls the sending side device and the receiving side device. Respective sections are connected with buses not shown. In this embodiment, the host apparatus 30 controls the card reader 10 and the card collection and return module 20.

The control section 50 is a control arithmetic operation means such as a CPU (Central Processing Unit), a MPU (Micro Processing Unit), a GPU (Graphics Processing Unit), a DSP (Digital Signal Processor) and an ASIC (Application Specific Integrated Circuit). The storage section 51 is a not-temporary recording medium such as a RAM (Random Access Memory), a ROM (Read Only Memory), an HDD (Hard Disk Drive) and a Flash Memory. Further, various interfaces 52 include USB interfaces connected with the card reader 10 and the card collection and return module 20 for controlling these devices. In addition, various interfaces 52 may include, for example, an interface for a liquid crystal display of LVDS, an interface of LAN (Local Area Network), and the like. Further, the various interfaces 52 may be connected with a touch panel, ten keys, a display and the like (not shown) of a main body such as an ATM.

The storage section 51 stores an embedded type OS, an application for ATM or the like (Application Software), middleware, a device driver and other data and the like. The application performs the entire control of the ATM and the like and is a program and the like for providing a user interface. Further, the middleware is a program and the like including an API and the like controlling various devices. Further, the device driver includes execution codes (Binary code) and the like for a library, a DLL, a class driver and an object server for controlling the respective devices corresponding to the API. In this embodiment, flow of information between respective objects, classes, processes and the like are described in the software structure of the embedded OS on the basis of Windows (registered trademark) made by Microsoft (registered trademark) Corporation, but the present invention is not limited to this embodiment. In other words, an embedded OS, a real time OS and the like using POSIX (registered trademark) such as Linux (registered trademark) may be applicable.

The host apparatus 30 also includes a frame on which the card reader 10, the card collection and return module 20 and other devices are arranged, a power supply circuit and the like.

[Functional Structure of Card Conveyance System 1]

Figure 3:
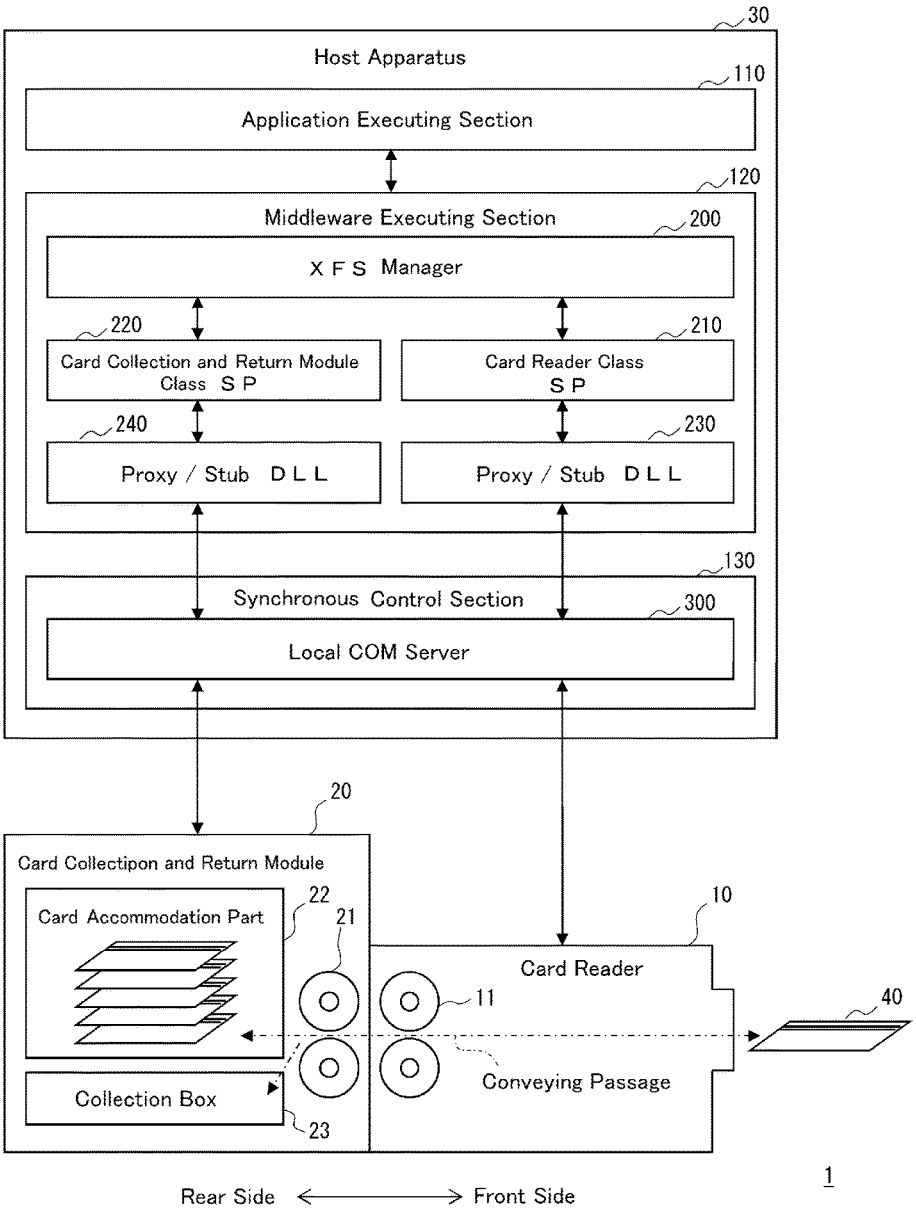
FIG. 3 is a block diagram showing a functional structure of a card conveyance system in accordance with an embodiment of the present invention.

Next, a functional block structure of the card conveyance system 1 will be described below with reference to FIG. 3. In the host apparatus 30, the control section 50 executes the program stored in the storage section 51 (see FIG. 2) by using the hardware resource and thereby the host apparatus 30 functions as an application executing section 110, a middleware executing section 120, and a synchronous control section 130.

The application executing section 110 executes an application which is a user interface for performing transactions as an ATM or the like. The application executing section 110 instructs the middleware executing section 120 with a command of a standard specification to control the sending side device and the receiving side device. The application executing section 110 issues, for example, a command corresponding to the API specified in the CEN/XFS to the middleware executing section 120 as the standard specification. Further, the application executing section 110 is also capable of issuing a command in conformity with the API which is a de-facto standard prepared in a specific device market as a command of a standard specification. Therefore, even when a device of any manufacturer is connected, similar processing can be executed.

The middleware executing section 120 executes middleware which controls the receiving side device and the sending side device in correspondence with a command of a standard specification from the application executing section 110.

In this embodiment, the middleware executing section 120 includes an XFS manager 200, SPs corresponding to the respective devices, and Proxy/Stub DLLs. In this embodiment, a card reader class SP 210 and a card collection and return module class SP 220 are included as the SPs corresponding to the respective devices. Further, Proxy/Stub DLLs 230 and 240 respectively corresponding to the SPs are included.

The XFS manager 200 interprets a command of a standard specification from the application executing section 110, executes API and the like calling the respective SPs, and provides interfaces to the respective SPs. In this manner, the XFS manager 200 performs management between the SPs. The API of the XFS manager 200 is, for example, provided as a DLL or the like of SDK (Software Development Kit) of CEN/XFS of respective companies.

The card reader class SP 210 is an SP executing processing corresponding to a command such as calling of a function or state management of the card reader 10. In this embodiment, the card reader class SP 210 executes processing in conformity with the CEN/XFS standard. The card reader class SP 210 executes processing corresponding to a command such as reading or writing of a card 40, collection of a card 40, initialization (resetting), ejection of a card 40, or notifying its state. Further, in this embodiment, the card reader class SP 210 does not call a DLL of the device driver directly but calls the Proxy/Stub DLL 230. In other words, the card reader class SP 210 having received a command transmits the command to a local COM server 300 of the synchronous control section 130 through the Proxy/Stub DLL 230.

The card collection and return module class SP 220 is an SP which executes calling of a function of the card collection and return module 20, its state management and the like.

The card collection and return module class is not a class specified in the CEN/XFS but executes processing corresponding to a command of API of a de-facto standard. The card collection and return module class SP 220 executes processing corresponding to commands such as start of card collection, returning of a card, notifying its state, end of card return, and resetting. Further, in this embodiment, the card collection and return module class SP 220 does not also directly call a DLL of the device driver, but calls the Proxy/Stub DLL 240. In other words, the card collection and return module class SP 220 having received a command transmits the command to the local COM server 300 through the Proxy/Stub DLL 240.

The Proxy/Stub DLLs 230 and 240 are in-process object servers (In Process Server) for communicating between processes with the local COM server 300 of the synchronous control section 130 which is activated as a process which is different from the application. The Proxy/Stub DLLs 230 and 240 execute marshalling the commands sent from the respective SPs in the proxy sections and transmit data to the process of the local COM server 300. In other words, the Proxy/Stub DLLs 230 and 240 enable to use objects in different processes by using a proxy and a stub.

In accordance with an embodiment of the present invention, the application executing section 110 and the middleware executing section 120 including the XFS manager 200 and the SPs may be executed as the same process on the OS by the control section 50. Further, the synchronous control section 130 may be executed as another process on the OS by the control section 50.

The synchronous control section 130 acquires a command of a standard specification which is acquired from the application executing section 110 by the middleware executing section 120 and actually transmits commands for control to the respective devices. In this case, the synchronous control section 130 controls a conveying roller of the sending side device and a conveying roller of the receiving side device synchronously with conveyance of a card 40 as necessary. Specifically, in this embodiment, for example, when the synchronous control section 130 acquires a command of card collection, the synchronous control section 130 sets the card reader 10 as a sending side device and the card collection and return module 20 as a receiving side device. In this case, the synchronous control section 130 controls to drive the conveying roller 21 of the card collection and return module 20 in synchronization with the drive of the conveying roller 11 of the card reader 10. Further, for example, when the synchronous control section 130 acquires a command of card return, the synchronous control section 130 sets the card collection and return module 20 as a sending side device and the card reader 10 as a receiving side device. In this case, the synchronous control section 130 controls to drive the conveying roller 11 of the card reader 10 in synchronization with the drive of the conveying roller 21 of the card collection and return module 20.

The synchronous control section 130 drives a conveying roller of the receiving side device at the same speed or at a higher speed than that of a conveying roller of the sending side device. Specifically, in this embodiment, for example, when the synchronous control section 130 acquires a command of card collection, the synchronous control section 130 drives the conveying roller 21 of the card collection and return module 20 at the same speed or at a higher speed than that of the conveying roller 11 of the card reader 10. Further, for example, when the synchronous control section 130 acquires a command of card return, the synchronous control section 130 drives the conveying roller 11 of the card reader 10 at the same speed or at a higher speed than that of the conveying roller 21 of the card collection and return module 20.

The synchronous control section 130 starts driving of the conveying roller of a receiving side device before driving of the conveying roller of a sending side device. Specifically, the synchronous control section 130 transmits a command to the receiving side device for driving its conveying roller at an earlier timing than start of driving of a conveying roller of the sending side device and thereby the conveying roller of the receiving side device is driven first. In this case, in this embodiment, for example, when the synchronous control section 130 acquires a command of card collection, the synchronous control section 130 transmits a command to start driving of the conveying roller 21 of the card collection and return module 20 at an earlier timing than driving of the conveying roller 11 of the card reader 10. Further, for example, when the synchronous control section 130 acquires a command of card return, the synchronous control section 130 transmits a command to start driving of the conveying roller 11 of the card reader 10 at an earlier timing than driving of the conveying roller 21 of the card collection and return module 20. The earlier timing may be about several hundred milliseconds.

In accordance with an embodiment of the present invention, it may be controlled that the synchronous control section 130 transmits commands to drive the conveying roller of the sending side device and the conveying roller of the receiving side device substantially simultaneously, but that the command transmitted to the conveying roller of the sending side device includes a command of time delay by which drive start is delayed by a predetermined time. In this case, for example, when the synchronous control section 130 acquires a command of card collection, the synchronous control section 130 substantially simultaneously transmits drive commands (control command) to the conveying roller 21 of the card collection and return module 20 and the conveying roller 11 of the card reader 10. However, the synchronous control section 130 makes a command transmitted to the conveying roller 11 of the card reader 10 include a wait command for a predetermined time. Further, for example, when the synchronous control section 130 acquires a command of card return, the synchronous control section 130 substantially simultaneously transmits drive commands to the conveying roller 21 of the card collection and return module 20 and the conveying roller 11 of the card reader 10. However, the synchronous control section 130 makes a command transmitted to the conveying roller 21 of the card collection and return module 20 include a wait command for a predetermined time.

In order to realize the above-mentioned method, in this embodiment, the synchronous control section 130 contains a local COM server 300 used in common in the respective devices.

The local COM server 300 is a kind of a shared object server and is mounted as an out process server. The local COM server 300 performs unmarshalling data received from the proxy/stub DLL 230 corresponding to the card reader class SP 210 and the proxy/stub DLL 240 corresponding to the card collection and return module class SP 220 in a stub section. Then, the local COM server 300 appropriately transmits commands to the card reader 10 and the card collection and return module 20. In this manner, the local COM server 300 acquires commands of a standard specification transmitted to the middleware executing section 120 from the application executing section 110. Then, the local COM server 300 respectively transmits dedicated commands (control command) for each device obtained by segmenting the acquired command to the card collection and return module 20 and the card reader 10 through USB class drivers or the like. In this case, the local COM server 300 synchronously controls the conveying rollers 11 and 21 as described above. As a result, when a card is to be conveyed, the conveying rollers 11 and 21 of two devices can be driven while correlating to each other and thus abrasion of the conveying rollers 11 and 21 can be prevented.

The control section 50 functions as the application executing section 110 and the middleware executing section 120 by executing the application stored in the storage section 51 and the DLLs and the like of the middleware which are compiled and included. Further, the control section 50 executes the device drivers and the like stored in the storage section 51 and thereby functions as the synchronous control section 130.

[Card Collecting Processing in Accordance with an Embodiment of the Present Invention]

Figure 4:
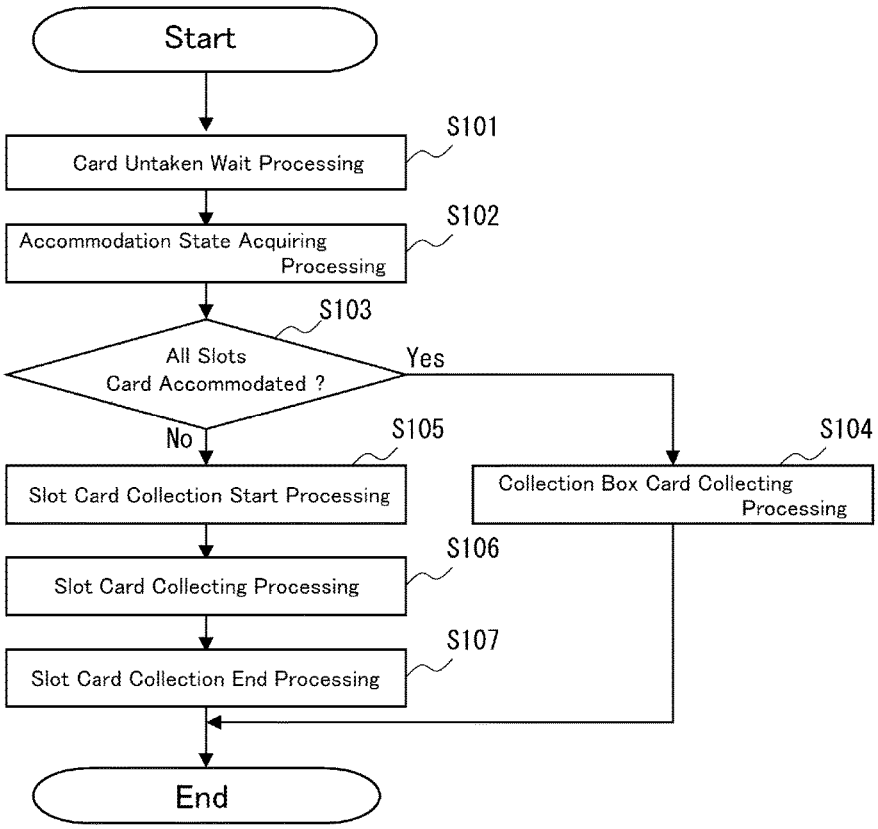
FIG. 4 is a flow chart showing a card collection processing in accordance with an embodiment of the present invention.

Next, card collecting processing in the card conveyance system 1 in accordance with an embodiment of the present invention will be described below with reference to FIG. 4. In card collecting processing in this embodiment, a card 40 having been left untaken is temporarily taken into the card reader 10 and, after that, the card 40 is accommodated in the card collection and return module 20. Each device connected with the host apparatus 30 is different in mechanism for each manufacturer. However, the application executing section 110 issues common commands of a standard specification regardless of a manufacturer. In this case, a command is executed for each step to the card reader class SP 210 and the card collection and return module class SP 220 from the application executing section 110 of the host apparatus 30 through the XFS manager 200 of the middleware executing section 120. The card collecting processing will be described in detail below for each step with reference to a flow chart in FIG. 4. The card collecting processing is executed by respective sections of the control section 50 of the host apparatus 30 using hardware resources.

(Step S101)

First, the control section 50 performs card untaken wait processing. After a transaction has finished in an ATM or the like, in a case that the card reader 10 detects that a user has forgotten to take out the card 40, in other words, in a case that it is detected by a sensor that a card 40 is left untaken in a gate insertion port, the application executing section 110 waits until a predetermined time has elapsed. The predetermined time may be, for example, set about 40 seconds in the application. When the predetermined time has elapsed from the detection of the card 40 left untaken, processing of collection of the card 40 is started as described below.

(Step S102)

Next, the control section 50 performs accommodation state acquiring processing. The application executing section 110 transmits a state notifying command to the card collection and return module class SP 220 of the middleware executing section 120. The state notifying command is a command for making the card collection and return module 20 confirm states of respective slots. The card collection and return module class SP 220 transmits the state notifying command to the local COM server 300 of the synchronous control section 130 through the proxy/stub DLL 240. The local COM server 300 transmits a command corresponding to the state notifying command to the card collection and return module 20 via a USB connection.

(Step S103)

Next, the control section 50 determines whether a card 40 is accommodated in all slots or not. In this case, the local COM server 300 of the synchronous control section 130 acquires a reply for the command corresponding to the state notifying command from the card collection and return module 20 and transmits it to the card collection and return module class SP 220 of the middleware executing section 120 through the proxy/stub DLL 240. The card collection and return module class SP 220 determines as "Yes" when cards 40 are existed, in other words, accommodated in all slots of the card accommodation part 22. The card collection and return module class SP 220 determines as "No" when the card accommodation part 22 has a slot where a card is not accommodated yet, in other words, a vacant slot. The card collection and return module class SP 220 notifies the determination result to the application executing section 110. In a case of "Yes", the control section 50 performs processing of the step S104. In a case of "No", the control section 50 performs processing of the step S105.

(Step S104)

When a card is accommodated in all slots, the control section 50 performs collection box card collecting processing. When a card 40 is existed in all the slots of the card accommodation part 22, the application executing section 110 transmits a card collection command to the card reader class SP 210 of the middleware executing section 120 for collecting a card 40 to a collection box. The card reader class SP 210 transmits the card collection command to the local COM server 300 of the synchronous control section 130 through the proxy/stub DLL 230. As a result, the local COM server 300 acquires the card collection command and then, first, transmits a command to the card collection and return module 20 for moving the card accommodation part 22 to the home position. Therefore, a card 40 can be dropped to the collection box 23 located to a lower part of the card accommodation part 22. After that, the control section 50 terminates the collection box card collecting processing.

After that, the local COM server 300 starts to drive the conveying roller 21 of the card collection and return module 20 in a direction in which the card 40 is taken to a rear side. The local COM server 300 waits for a predetermined time of about several hundred milliseconds after the drive of conveying roller 21 is started and then the local COM server 300 transmits a command corresponding to a card collection command to the card reader 10. As a result, the card 40 is taken into the card reader 10. After that, the local COM server 300 drives the conveying roller 11 to send the card 40 to the card collection and return module 20. As a result, the card 40 having been sent is received by the card collection and return module 20 and is collected in the collection box 23 as it is through the conveying roller 21 having been driven already.

(Step S105)

In a case that the card accommodation part 22 has a vacant slot, the control section 50 performs slot card collection start processing. In this case, the application executing section 110 transmits a card collection start command to the card collection and return module class SP 220 of the middleware executing section 120. The command includes information which specifies a slot position and the like. The application executing section 110 moves the card accommodation part 22 to a position where the card 40 sent from the card reader 10 is capable of being accommodated.

(Step S106)

Next, the control section 50 performs slot card collecting processing. When the local COM server 300 of the synchronous control section 130 acquires a card collection start command through the proxy/stub DLL 240, the local COM server 300 transmits a command to the card collection and return module 20 for moving a vacant slot of the card accommodation part 22 to a conveyance port for the card 40 of the conveying passage.

Successively, the application executing section 110 issues a card collection command to the card reader class SP 210 of the middleware executing section 120. When the local COM server 300 receives the command, first, the conveying roller 21 on a front side of the card collection and return module 20 is started to drive in a direction in which the card 40 is conveyed and taken to a rear side. After that, the local COM server 300 waits for a predetermined time and then transmits a command corresponding to a card collection command to the card reader 10. As a result, similarly to the collection box card collecting processing, the card 40 is taken into the card reader 10. In this case, the card reader 10 reads information of the card 40 and transmits the information to the card reader class SP 210. The card reader class SP 210 transmits the information of the card 40 to the application executing section 110. The application executing section 110 stores the information of the card 40 in the storage section 51 in association with the slot where the card is accommodated. The local COM server 300 drives the conveying roller 11 to send the card 40 taken into the card reader 10 to the card collection and return module 20. When the card collection and return module 20 receives the card 40, the card 40 is accommodated in a slot of the card accommodation part 22 by the conveying roller 21 having been already driven.

(Step S107)

Next, the control section 50 performs slot card collection end processing. Finally, the application executing section 110 issues a card collection end command to the card collection and return module class SP 220 of the middleware executing section 120. When the local COM server 300 of the synchronous control section 130 acquires this command through the proxy/stub DLL 240, the local COM server 300 confirms that the card 40 has been accommodated in a vacant slot of the card collection and return module 20 by a signal of a sensor or the like, and transmits a command for moving the card accommodation part 22 where the card 40 has been accommodated to the home position. In this manner, the card collecting processing in accordance with an embodiment of the present invention has been ended.

[Card Return Processing in Accordance with an Embodiment of the Present Invention]

Figure 5:
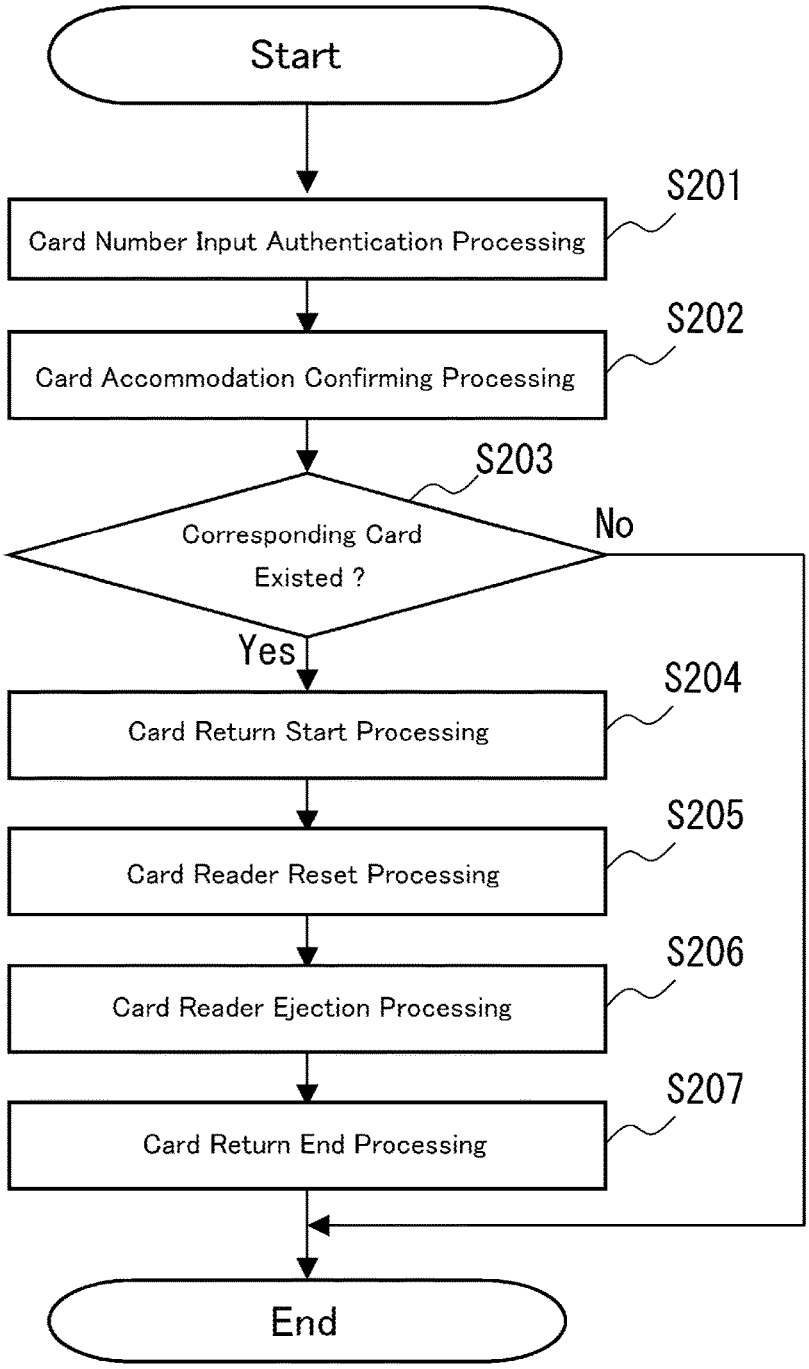
FIG. 5 is a flow chart showing a card return processing in accordance with an embodiment of the present invention.

Next, card return processing in the card conveyance system 1 in accordance with an embodiment of the present invention will be described below with reference to FIG. 5. In the card return processing in this embodiment, a card 40 accommodated in a slot of the card collection and return module 20 is returned to a user. In this case, according to the specification of CEN/XFS, a command for inserting a card 40 from a rear side is not provided in a class for card reader control. Therefore, for example, while a card 40 is returned from the card collection and return module 20, parallel processing of taking the card 40 from a rear side of the card reader 10 cannot be performed. Further, a conveying method of a card 40 in the card collection and return module 20 is different for each manufacturer. For example, there are a method to convey a card 40 by a roller, a method in which a card accommodation part is moved to front and rear sides for moving a card 40, and the like. Therefore, there may be a case that parallel processing with the card reader 10 is difficult when a card is to be returned. Accordingly, also in card return processing, respective commands are executed in respective steps without performing parallel processing. Card return processing will be described in detail below for each step with reference to a flow chart in FIG. 5. The card return processing is also executed by respective sections of the control section 50 of the host apparatus 30 using hardware resources.

(Step S201)

First, the control section 50 performs card number input authentication processing. In a case that a user having forgotten to take out a card 40 instructs to return the card 40 through a touch panel or the like, the application executing section 110 requests the user to input numerical values and the like of last four digits of the card 40 to perform personal authentication. The application executing section 110 first performs identity verification by requesting the user to input numerical values of last four digits of the card number of the card 40 or the like and, if required, by reading information of the personal authentication card or the like of the user by a non-contact type IC card reader or the like not shown.

(Step S202)

Next, the control section 50 performs card accommodation confirming processing. The application executing section 110 refers to information of the card 40 stored in the storage section 51 and confirms whether a designated card 40 is accommodated in one of the slots of the card accommodation part 22 or not.

(Step S203)

Next, the control section 50 determines whether the corresponding card 40 is existed or not. The application executing section 110 determines as "Yes" when the corresponding card 40 is accommodated in one of the slots of the card accommodation part 22. The application executing section 110 determines as "No" when the corresponding card 40 is not found. In other words, even when the card 40 is collected in the collection box 23 without being collected in the slots of the card accommodation part 22, the application executing section 110 determines as "No". In the case of "Yes", the control section 50 performs processing of the step S204. In the case of "No", the control section 50 terminates the card return processing. In other words, when the corresponding card 40 is not found, the card return processing is not performed. In this case, the control section 50 may display on a display part so as to call a person in charge.

(Step S204)

When the corresponding card 40 is existed, the control section 50 performs card return start processing. The application executing section 110 starts card return processing at the time of confirming that the designated card 40 is accommodated in a slot of the card accommodation part 22. First, the application executing section 110 issues a card return start command to the card collection and return module class SP 220 of the middleware executing section 120. In this case, the application executing section 110 specifies the slot where the card 40 to be returned is accommodated. The card collection and return module class SP 220 transmits the card return start command to the local COM server 300 of the synchronous control section 130 through the proxy/stub DLL 240.

The local COM server 300 acquires the card return start command and transmits a command to the card collection and return module 20 so that the designated slot of the card accommodation part 22 is moved so as to coincide with a conveyance port for the card 40 and to take out the card 40 from the slot by a lever mechanism. In this case, simultaneously, the local COM server 300 transmits a command to the card reader 10 for taking the card 40 from a rear side.

Therefore, the local COM server 300 starts driving the conveying roller 11 in a direction for taking the card 40 into an inside of the card reader 10. After that, the local COM server 300 waits for a predetermined time and then starts driving of the conveying roller 21 and conveys the card 40 taken out from the slot to a front side. In this manner, the card 40 is normally taken into an inside of the card reader 10.

(Step S205)

Next, the control section 50 performs card reader reset processing. The application executing section 110 successively issues a reset command to the card reader 10. Then, the card reader class SP 210 of the middleware executing section 120 transmits the reset command to the local COM server 300 of the synchronous control section 130 through the proxy/stub DLL 230. The local COM server 300 acquires this command and similarly transmits the command for resetting to the card reader 10.

When the card reader 10 is reset, a card 40 is moved to a predetermined position where the card 40 is normally held in an inside of the card reader 10. Therefore, even when a card 40 is forcibly inserted from a rear side of the card reader 10 like a conventional example, the card 40 is moved to the predetermined position. On the other hand, in this embodiment, the card 40 has been already taken into the inside of the card reader 10 from a rear side. Therefore, at the time when the card reader 10 is reset, the card 40 has been moved to the predetermined position. Accordingly, the application executing section 110 issues a reset command for maintaining compatibility with a conventional application. In other words, if compatibility is not required, the application executing section 110 may not issue a reset command.

(Step S206)

Next, the application executing section 110 performs card reader ejection processing. The application executing section 110 issues a card ejection command next to the reset command. The card ejection command is a command for ejecting the card 40 located at the predetermined position of the card reader 10 from a gate insertion port of the device. The card reader class SP 210 of the middleware executing section 120 transmits the ejection command to the local COM server 300 of the synchronous control section 130 through the proxy/stub DLL 230. The local COM server 300 transmits the command to the card reader 10 for ejecting the card 40 from the gate insertion port along the conveying passage.

(Step S207)

Next, the control section 50 performs card return end processing. Finally, the application issues a card return end command to the card collection and return module class SP 220. The card collection and return module class SP 220 of middleware executing section 120 transmits the card return end command to the local COM server 300 of the synchronous control section 130 through the proxy/stub DLL 240. The local COM server 300 acquires the card return end command and transmits a command for moving the card accommodation part 22 of the card collection and return module 20 to the home position. As a result, the card return processing in accordance with an embodiment of the present invention is terminated.

Principal Effects of this Embodiment

Following effects can be attained since the system is structured as described above. Conventionally, in a technique as described in the above-mentioned Patent Literature, a card 40 may not be smoothly conveyed between the two devices. On the other hand, the card conveyance system 1 in accordance with an embodiment of the present invention includes, as two devices, a card reader 10 or a card collection and return module 20 which is a sending side device for sending a card 40 along a conveying passage, the card collection and return module 20 or the card reader 10 which is a receiving side device for receiving the card 40 from the sending side device along the conveying passage, and a host apparatus 30 which controls the sending side device and the receiving side device. The sending side device and the receiving side device are also respectively function as a receiving side device and a sending side device. The host apparatus 30 includes the application executing section 110 which executes an application including a user interface, the middleware executing section 120 which executes middleware controlling the receiving side device and the sending side device corresponding to a command of a standard specification from the application executing section 110, and the synchronous control section 130 which acquires the command of a standard specification acquired from the application executing section 110 by the middleware executing section 120 and controls a conveying roller of the sending side device and a conveying roller of the receiving side device synchronously with conveyance of the card 40 as necessary. According to this structure, the two devices can be controlled while the command is related and thus sending and receiving of a card 40 can be smoothly performed between the two devices. In other words, when a card 40 is to be conveyed, both of the conveying roller 11 located on a rear side of the card reader 10 and the conveying roller 21 located on a front side of the card collection and return module 20 can be smoothly and synchronously rotated according to conveyance of the card 40. As a result, abrasion of the respective conveying rollers 11 and 21 can be minimized and, in addition, damage to the card 40 can be also suppressed.

Conventionally, when devices corresponding to a command of a standard specification are simply connected and used, a problem such as a trouble during conveyance and shortening of life of the conveying rollers 11 and 21 may occur as described above. On the other hand, the card conveyance system in this embodiment provides complementary means for processing of a command of a standard specification. Therefore, a device for performing conveyance of a card can be easily added and detached. Accordingly, development of an application is easy and development cost can be reduced.

In the card conveyance system 1 in accordance with an embodiment of the present invention, the synchronous control section 130 includes the local COM server 300 that is a shared object server which transmits a command to the sending side device and the receiving side device. According to this structure, control can be requested from the local COM server which is a kind of a shared object server to the sending side device and the receiving side device. Therefore, in a case that only control of one device of the sending side device and the receiving side device is insufficient, the two devices can be controlled while relating to a command. Accordingly, conveyance of a card 40 can be performed smoothly.

In the card conveyance system 1 in accordance with an embodiment of the present invention, the synchronous control section 130 drives the conveying roller of the receiving side device at an equal speed or a higher speed than that of the conveying roller of the sending side device. According to this structure, a card 40 can be driven smoothly. In other words, when a rotating speed of the conveying roller of the receiving side device is slower than a rotating speed of the conveying roller of the sending side device, a card 40 is stagnated between the two conveying rollers. However, when a rotating speed of the roller of the receiving side device is set to be equal or faster, a card 40 can be smoothly sent without stagnation.

In the card conveyance system 1 in accordance with an embodiment of the present invention, the synchronous control section 130 starts driving of the conveying roller of the receiving side device before driving of the conveying roller of the sending side device. Further, in the card conveyance system 1 in accordance with an embodiment of the present invention, the synchronous control section 130 may transmits a command to the receiving side device for driving its conveying roller at an earlier timing than driving start of the conveying roller of the sending side device. The earlier timing may be, for example, about several hundred milliseconds. Further, in the card conveyance system 1 in accordance with an embodiment of the present invention, it may be structured that, although the synchronous control section 130 transmits commands for simultaneously driving the conveying roller of the sending side device and the conveying roller of the receiving side device, the command transmitted to the conveying roller of the sending side device includes a delay time command which delays the drive start for a predetermined time (for example, about several hundred milliseconds). According to this structure, since the conveying roller of the receiving side device is driven first, a card 40 can be conveyed smoothly. In other words, a card 40 is not stopped between the conveying roller of the receiving side device and the conveying rollers of the sending side device. Therefore, abrasion of the conveying roller of the sending side device can be prevented. Further, a rotating speed of the conveying roller of the receiving side device can be set the same or faster than that of the sending side device by starting the rotation of a driving roller of the receiving side device earlier than a driving roller of the sending side device. Therefore, a card 40 can be conveyed smoothly.

In the card conveyance system 1 in accordance with an embodiment of the present invention, the sending side device and the receiving side device may be respectively one of a card reader 10 structured to contact with a card 40 and read and write information, a non-contact IC card reader 10 structured to read and write information in a card 40 in a non-contact state, a card collection and return module 20 structured to collect and return a card 40, an image reader structured to optically read a card 40, and a printer structured to print on a card 40. According to this structure, card conveyance control in accordance with an embodiment of the present invention is applied to various devices in which a card 40 is driven along a conveying passage, and sending and receiving of a card can be controlled smoothly.

Other Embodiments

In the embodiment described above, the SPs corresponding to the sending side device and the receiving side device transmit commands to a single local COM server of the synchronous control section 130. However, the SP is not necessarily accessed by a single application, control program such as a device driver located in a lower layer of the SP may be mounted in a different process such as a server or a service. In this case, a command cannot be acquired by a single local COM server. Therefore, in a card conveyance system 2 in accordance with another embodiment of the present invention, inter-process communication is performed between the processes and the control is mounted by DLL or the like as middleware. Also in another embodiment, a card 40 is conveyed in a state that a card reader 10 and a card collection and return module 20 are connected with each other as two devices.

[Functional Structure of Card Conveyance System 2]

Figure 6:
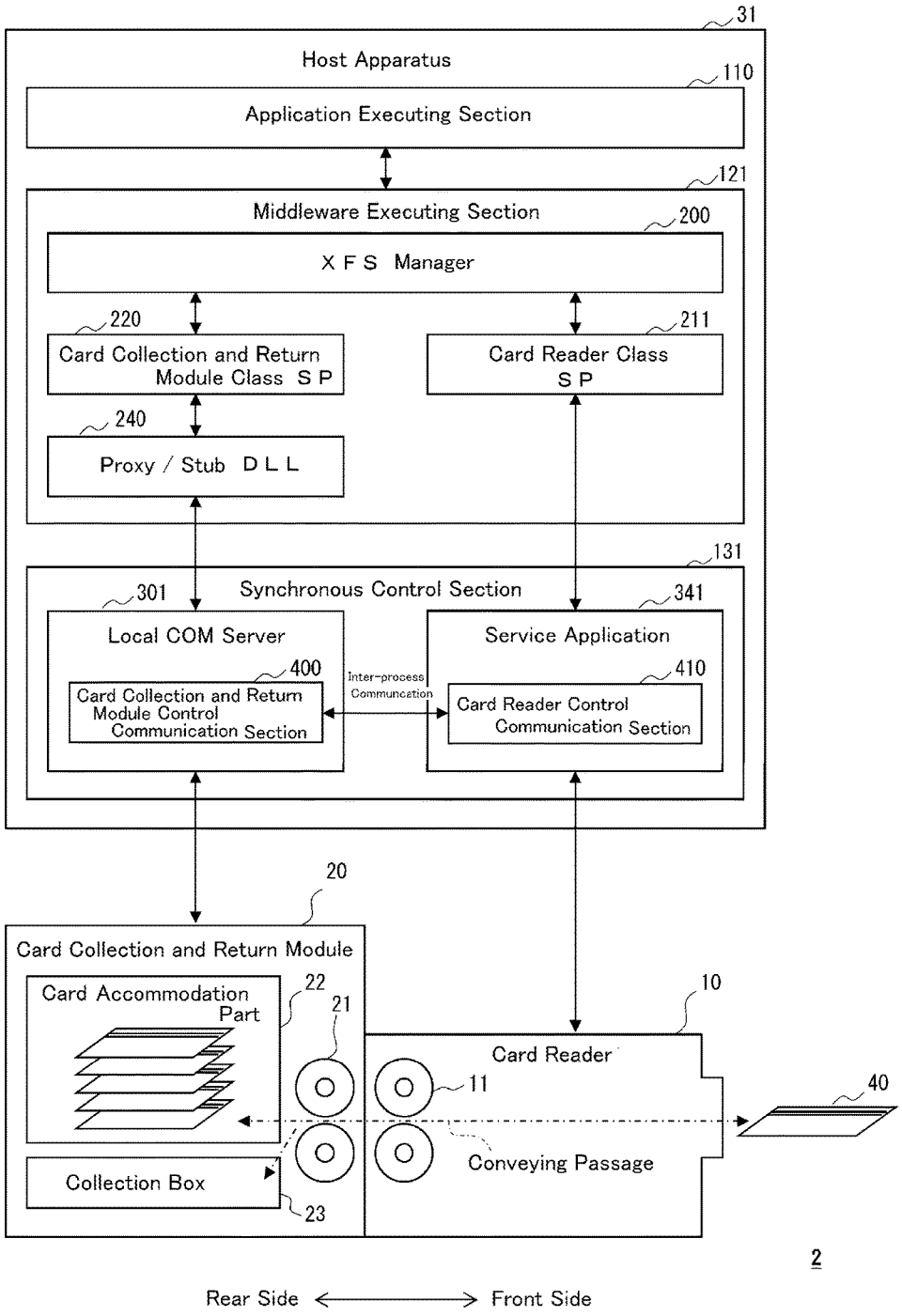
FIG. 6 is a block diagram showing a system structure of a card conveyance system in accordance with another embodiment of the present invention.

Next, a functional block structure of the card conveyance system 2 will be described below with reference to FIG. 6. In FIG. 6, similar structural elements to FIG. 3 are shown by using the same reference signs. Also in a host apparatus 31 in another embodiment, an application executing section 110 executes an application which is a user interface for performing transactions as an ATM or the like. An API which is capable of executing a command of a standard specification such as CEN/XFS is provided to the application executing section 110.

Therefore, also in another embodiment, a middleware executing section 121 includes an XFS manager 200, a card reader class SP 211, a card collection and return module class SP 220, and a proxy/stub DLL 240. The XFS manager 200 performs, similarly to the above-mentioned embodiment, management between the respective SPs and notifies commands to the respective SPs. The card collection and return module class SP 220 is an SP for controlling the card collection and return module 20. The card reader class SP 211 is an SP for controlling the card reader 10 like the card reader class SP 210 in the above-mentioned embodiment (see FIG. 3).

In another embodiment, the card reader class SP 211 transmits a command by using a service of OS. In other words, the card reader class SP 211 transmits a command of a standard specification to a service application 341 of the synchronous control section 131 which is a service application (Service Application Software). In the service application 341 having received the command, a binary of a device driver and the like is executed and the card reader is controlled. On the other hand, the card collection and return module class SP 220 for controlling the card collection and return module 20 transmits, similarly to the above-mentioned embodiment, a command to the local COM server 301 of the synchronous control section 131 by a proxy/stub DLL 240. The local COM server 301 in another embodiment controls the card collection and return module 20.

In the another embodiment, as described above, the service application 341 and the local COM server 301 are different processes and thus inter-process communications are required to be performed. Therefore, a card reader control communication section 410 is mounted and included as middleware in the service application 341. Further, a card collection and return module control communication section 400 is mounted and included as middleware in the local COM server 301. The commands acquired from the respective SPs are transmitted and received between the control communication sections through inter-process communication.

Specifically, the card reader class SP 211 having received a command of a standard specification sends a request for controlling the card reader 10 to the service application 341 which is a process for device control. The service application 341 transmits a command to the card reader 10 corresponding to the requested command and controls. Further, in a case that control of only the card reader 10 is insufficient, the card reader control communication section 410 requests the card collection and return module control communication section 400 to control the card collection and return module 20 by utilizing inter-process communication. On the other hand, the card collection and return module class SP 220 having received the command sends a request for controlling the card reader 10 to the local COM server 301 which is a process for device control and controls the card collection and return module 20 based on the requested command. Further, the card collection and return module control communication section 400 requests the card reader control communication section 410 to control the card collection and return module 20 by utilizing inter-process communication.

[Card Collecting Processing in Accordance with Another Embodiment of the Present Invention]

Next, card collecting processing in accordance with another embodiment of the present invention will be described below with reference to FIG. 7. In the another embodiment of the present invention, similar processing to the card collecting processing described with reference to the flow chart in FIG. 4 are realized by using the above-mentioned inter-process communication.

Figure 7:
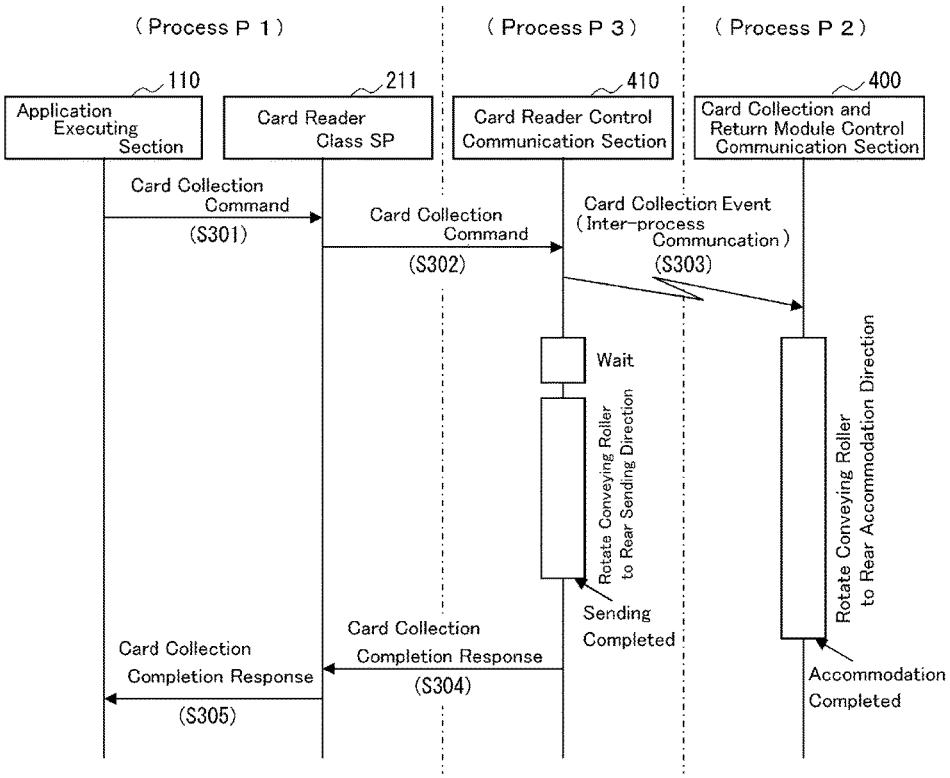
FIG. 7 is a timing chart showing a card collection processing in accordance with another embodiment of the present invention.

FIG. 7 shows a flow of collection of a card 40 and contents of inter-process communication which are executed by the middleware executing section 121 and the synchronous control section 131 of the control section 50. In this example, the application executing section 110 and the card reader class SP 211 are executed as the same process "P1", the local COM server 301 including the card collection and return module control communication section 400 is executed as a process "P2", and the service application 341 including the card reader control communication section 410 is executed as a process "P3", and they are respectively executed as different processes on the OS. A named event and data communication (command/response) utilizing a named pipe are chosen and used depending on application in an event and data communication between the processes at the time of card collection. As described above, since a name is utilized, a common event or a common communication pipe can be utilized in two different processes. Next, the processing will be described in detail below for each step with reference to a timing chart in FIG. 7. In the card collecting processing in accordance with the another embodiment of the present invention, respective sections of the control section 50 of the host apparatus 30 execute the processing by using hardware resources.

First, after a transaction is performed in an ATM or the like, in a case that a predetermined time such as 40 seconds, for example, has elapsed after a card 40 is left untaken by a user, the application executing section 110 starts collecting processing of the card 40. Similarly to the above-mentioned embodiment, the application executing section 110 transmits a state notifying command to the card collection and return module class SP 220 to confirm states of slots of the card accommodation part 22. In a case that cards 40 are existed in all slots of the card accommodation part 22, a card collection command is issued to the card reader class SP 211 for collecting the card 40 to the collection box 23 (step S301). The card reader class SP 211 having received this command similarly notifies a card collection command to the card reader control communication section 410 (step S302).

When the service application 341 receives a card collection command, the service application 341 first requests taking-in operation of the card 40 to the card collection and return module control communication section 400 through the card reader control communication section 410. After that, the service application 341 transmits a command to the card reader 10 for conveying the card 40 to a rear side of the card reader 10. As a result, the card 40 is collected in the collection box 23. In this case, operation of the conveying roller 11 of the card reader 10 and the conveying roller 21 of the card collection and return module 20 is similarly performed to the above-mentioned embodiment.

On the other hand, in a case that a vacant slot is existed in the card accommodation part 22, the application executing section 110 issues a card collection start command to the card collection and return module class SP 220. The command is, similarly to the above-mentioned embodiment, a command for moving the card accommodation part 22 to a position where the card is capable of being conveyed from the card reader 10. The card collection and return module control communication section 400 having received the command moves a vacant slot of the card collection and return module 20 to a conveyance port for the card 40.

The card reader control communication section 410 of the service application 341 having received the command first requests taking-in operation of the card 40 to the card collection and return module control communication section 400. For example, the card reader control communication section 410 generates an event which is capable of being received by the card collection and return module control communication section 400 (step S303).

The card collection and return module control communication section 400 having received the event immediately rotates the conveying roller 21 in a taking-in direction to the slot of the card accommodation part 22.

After the event is generated, the service application 341, similarly to the above-mentioned embodiment, performs processing for conveying the card 40 to a rear side of the card reader 10. In other words, the service application 341 waits for a predetermined time of about several hundred milliseconds. The predetermined time is a time estimated so that the roller of the collection module starts to rotate. After that, the service application 341 rotates the conveying roller 11 of the card reader 10 rearward to eject the card 40 to a rear side and the card 40 is sent to the card reader collection and return module. In this manner, the card 40 is taken to the card collection and return module and collected from the conveyance port in a designated slot of the card accommodation part 22.

The card reader 10 and the card collection and return module 20 detect completion of card ejection or completion of taking-in of the card based on states of sensors on the conveying passage and rotation of the rollers is stopped.

The card reader control communication section 410 notifies a response of card collection completion to the card reader class SP 211 at the time when the accommodation has ended after sending of the card 40 has completed (step S304). Further, the card reader class SP 211 having received this notification notifies a collection completion response to the application executing section 110 (step S305).

Finally, the application executing section 110 issues a card collection end command to the card collection and return module class SP 220. Similarly to the above-mentioned embodiment, the local COM server 301 receives the command and moves the slot of the card collection and return module 20 to the home position. In this manner, the card collecting processing in accordance with another embodiment of the present invention is terminated.

[Card Return Processing in Accordance with Another Embodiment of the Present Invention]

Next, card return processing in accordance with another embodiment of the present invention will be described below with reference to FIG. 8. In the card return processing in accordance with another embodiment, similar processing to the card return processing in accordance with the embodiment described with reference to the flow chart in FIG. 5 is realized by using the above-mentioned inter-process communication.

Figure 8:
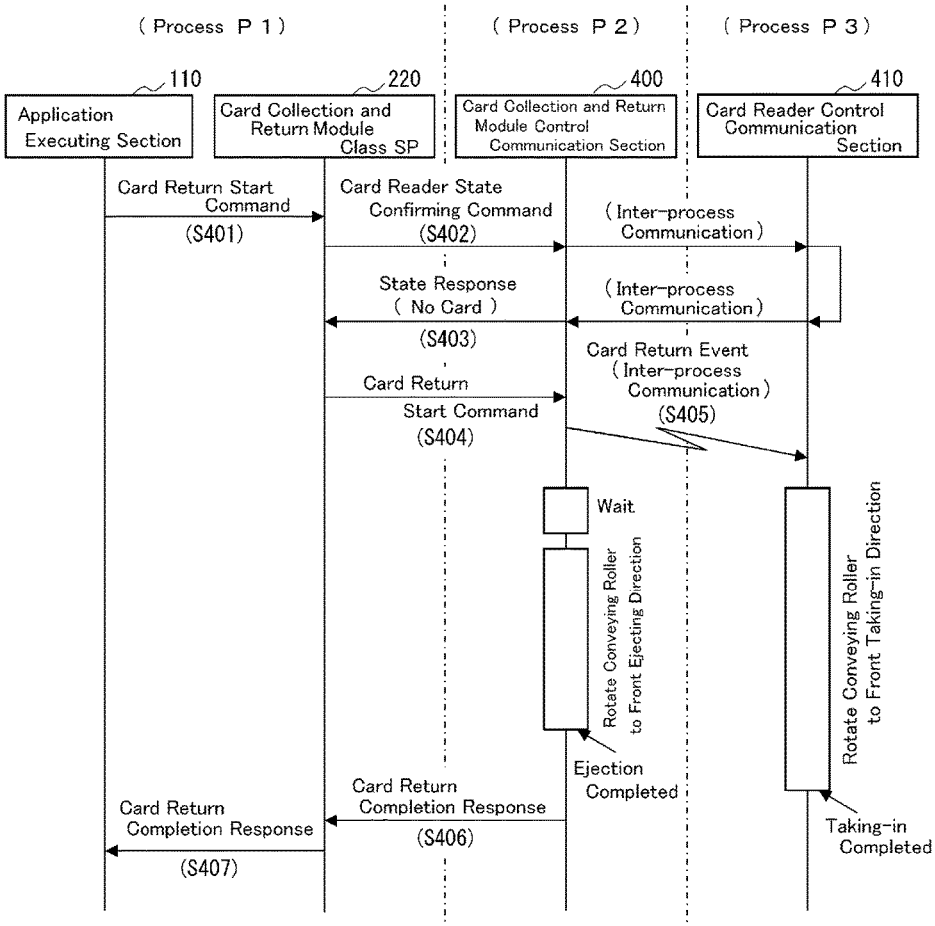
FIG. 8 is a timing chart showing a card return processing in accordance with another embodiment of the present invention.
Figure 9:
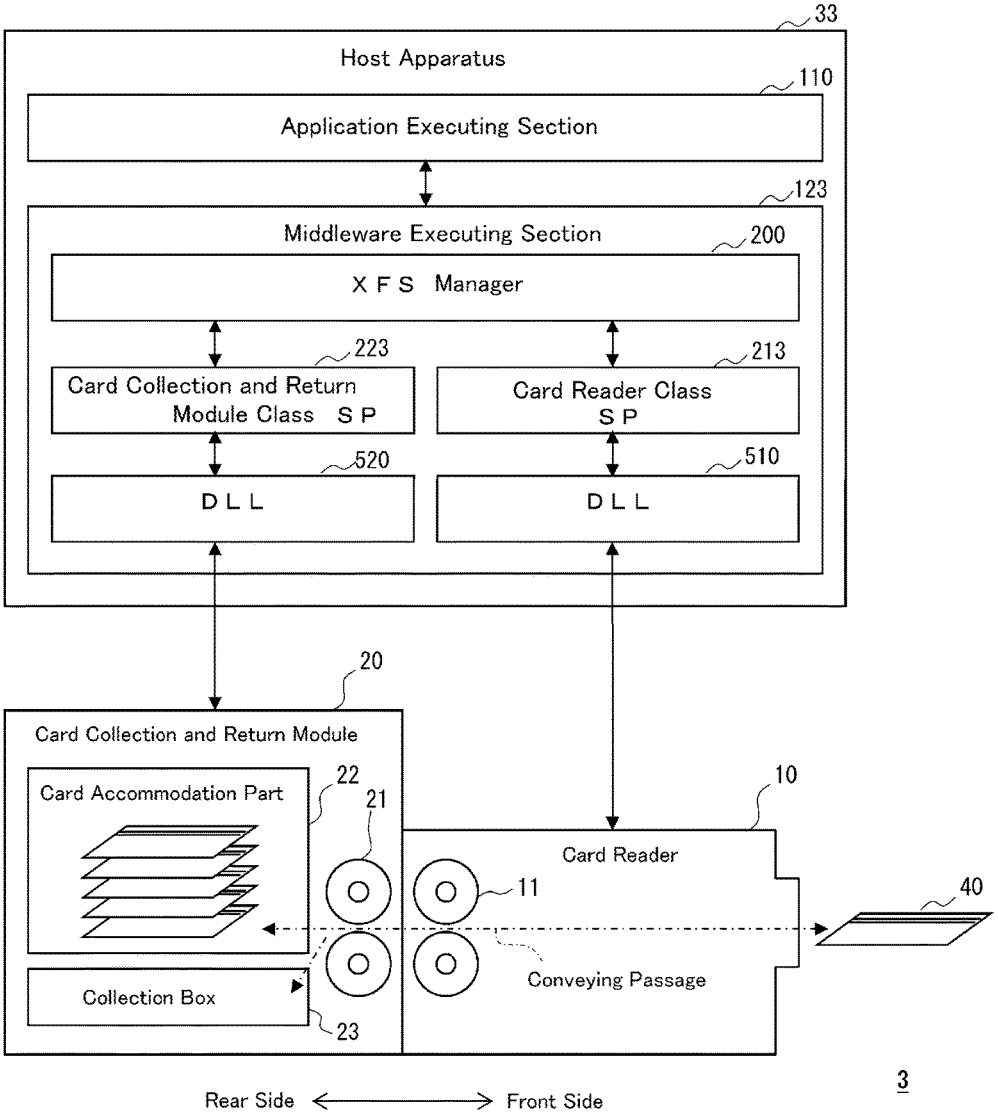
Fig. 9 Prior Art
FIG. 9 is a block diagram showing a system structure of a conventional card conveyance system.

FIG. 8 shows timing of the card return processing and contents of inter-process communication which are executed by the middleware executing section 121. Also in the card return processing in another embodiment of the present invention, a named event and data communication (command/response) utilizing a named pipe are chosen and used depending on application in an event and data communication. In other words, in a case that information such as a state is to be acquired between the processes, the information is acquired by utilizing data communication (command/response) utilizing a named pipe. On the other hand, in a case that parallel processing is performed without waiting for an execution result, a named event is utilized. Next, the processing will be described in detail below for each step with reference to a timing chart in FIG. 8. Also in the card return processing in another embodiment, respective sections of the control section 50 of the host apparatus 30 execute the processing by using hardware resources.

First, the user having forgotten to take out the card 40 is requested to input the numerical values of last four digits of the card number of the card 40 or the like or, if required, authentication or the like is performed by the personal authentication card and, after confirmed that the designated card 40 is accommodated in a slot, the card return processing is started. In this case, when the corresponding card 40 is not found, the return processing is not started.

In a case that the corresponding card 40 is existed, first, the application executing section 110 issues a card return start command to the card collection and return module class SP 220 of the middleware executing section 121 (step S401). In this case, the application executing section 110 designates the slot where the card 40 to be returned is accommodated.

The card collection and return module class SP 220 having received this command first issues a card reader state confirming command to the card collection and return module control communication section 400 of the local COM server 301 of the synchronous control section 131 (step S402). The card reader state confirming command is a command for confirming whether a card 40 is existed in an inside of the card reader or not. The card collection and return module control communication section 400 having received this command notifies the state confirming command to the card reader control communication section 410 as it is by using inter-process communication and waits a response. When the card collection and return module control communication section 400 receives the response, the card collection and return module control communication section 400 notifies the state to the card collection and return module class SP 220 as it is (step S403).

The card collection and return module class SP 220 issues a card return start command after having confirmed that no card 40 is existed in an inside of the card reader (step S404). Similarly to the embodiment described above, the local COM server 301 of the synchronous control section 131 receives this command. Then, the card collection and return module control communication section 400 of the local COM server 301 generates a card return event which is capable of being received by the card reader control communication section 410 (step S405). Further, the card collection and return module control communication section 400 requests the card reader control communication section 410 to perform taking-in operation of a card 40 from a rear side. In other words, the card collection and return module control communication section 400 requests to rotate the conveying roller 11 disposed on a rear side of the card reader in a taking-in direction to its inside.

The card reader control communication section 410 having received the event immediately rotates the conveying roller 11 in a taking-in direction to the inside of the card reader.

After the card collection and return module control communication section 400 notifies the event, the card collection and return module control communication section 400 moves a designated slot of the card collection and return module 20 to the conveyance port. After that, the card collection and return module control communication section 400 waits a predetermined time of about several hundred milliseconds that is estimated so that the conveying roller 11 of the card reader starts to rotate. The wait may be executed by counting in the card collection and return module control communication section 400 or may be realized by including a delay time in the command. Then, the conveying roller 21 of the card collection and return module 20 is started to rotate in an ejecting direction to the front side. Further, the card collection and return module control communication section 400 takes out the card 40 from the slot by using a lever mechanism and rotates the conveying roller 21 of the card collection and return module 20 and thereby sends the card 40 from the slot to the card reader 10 disposed on the front side.

The application executing section 110 successively issues a reset command and an ejection command to the card reader class SP 211 in this order. The card reader control communication section 410 receives these commands and controls the card reader so that, after reset processing is performed on the card reader, the card 40 is conveyed to the gate port of the card reader.

The card reader 10 and the card collection and return module 20 detect completion of card ejection or completion of taking-in of the card based on states of sensors on the conveying passage and rotation of the rollers is stopped.

The card collection and return module control communication section 400 notifies a response of the completion of card return to the card collection and return module class SP 220 at the time when the card return has been completed (step S406). Further, the card collection and return module class SP 220 having received this response notifies a card return completion response to the application executing section 110 (step S407).

Finally, the application executing section 110 issues a card return end command to the card collection and return module class SP 220. The local COM server 301 receives the command and moves the slots of the card collection and return module 20 to the home position. In this manner, the card return processing in accordance with another embodiment of the present invention is terminated.

Following effects can be attained since the system is structured as described above. In the card conveyance system 2 in accordance with another embodiment of the present invention, the middleware executing section 121 controls the sending side device and/or the receiving side device by the service of OS, and the synchronous control section 131 transmits a command to the sending side device and/or the receiving side device controlled by the service through the inter-process communication of OS. According to this structure, control can be requested from the local COM server which is a kind of an object server to the sending side device and the receiving side device through the inter-process communication. Further, in addition, control can be requested to the sending side device and the receiving side device also from an application executed in different process by service of Windows (registered trademark) OS or the like. Therefore, two devices are controlled in different processes such as services and, even in a case that control of only one device is insufficient, the two devices can be controlled while relating to a command. Accordingly, conveyance of a card 40 can be performed smoothly. In accordance with an embodiment of the present invention, in the card conveyance system 2, the synchronous control section 131 may include a local COM server 301 which is a shared object server configured to transmit commands to the sending side device and the receiving side device. In addition, the middleware executing section 121 may also control the sending side device and/or the receiving side device by service of OS, and the synchronous control section 131 may transmit commands between the sending side device and/or the receiving side device controlled by the service application 341 controlled by service of OS and the sending side device and/or the receiving side device controlled by the local COM server 301 through inter-process communication of OS.

In the above-mentioned embodiment and the above-mentioned another embodiment, as an example, two devices and the host apparatus 30 or 31 are connected with each other via a USB connection. However, they may be connected with each other by, for example, RS-232C, other communication systems, a wired/wireless LAN or the like. Further, the respective devices may be directly connected with each other. When structured as described above, connection modes of two devices can be coped flexibly and, even when a conventional device is incorporated, similar control can be attained.

In the above-mentioned embodiment and the above-mentioned another embodiment, as an example, two devices are controlled by an application such as an ATM. However, the card conveyance system in at least an embodiment of the present invention may be applied, for example, to control for a device in a POS (Point of Service) system or the like. Further, in the above-mentioned embodiment and the above-mentioned another embodiment, two devices in conformity with CEN/XFS standard and API of a de-facto standard are controlled as an example. However, the card conveyance system in the present invention is not limited to the above-mentioned example and can be applied, for example, to another architecture such as OPOS standard utilized in POS system. According to this structure, two devices whose standards of applications are different from each other can be coped flexibly.

Although the present invention has been shown and described with reference to a specific embodiment, various changes and modifications will be apparent to those skilled in the art from the teachings herein.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A card conveyance system for use with a card, the card conveyance system comprising:

a first device;

a second device;

a conveying passage; and a host apparatus configured to control the first device and the second device;

wherein the first device is structured to send the card to the second device via the conveying passage and receive the card from the second device via the conveying passage;

the second device is structured to receive the card from the first device via the conveying passage and send the card to the first device via the conveying passage;

wherein the host apparatus comprises;

an application executing section configured to execute an application including a user interface;

a middleware executing section configured to execute middleware controlling the second device and the first device corresponding to a command of a standard specification from the application executing section; and a synchronous control section configured to acquire a command of the standard specification acquired from the application executing section by the middleware executing section and control a conveying roller of the first device and a conveying roller of the second device synchronously with conveyance of the card.

2. The card conveyance system according to claim 1, wherein the synchronous control section comprises a shared object server configured to transmit commands to the first device and the second device.

3. The card conveyance system according to claim 2, wherein the middleware executing section is configured to control at least one of the first device and the second device by service of OS, and the synchronous control section is configured to transmit a command to at least the one of the first device and the second device controlled by the service through inter-process communication of OS.

4. The card conveyance system according to claim 3, wherein the synchronous control section is configured to drive the conveying roller of the second device at an equal or higher speed than the conveying roller of the first device.

5. The card conveyance system according to claim 3, wherein the synchronous control section is configured to start driving of the conveying roller of the second device before driving start of the conveying roller of the first device.

6. The card conveyance system according to claim 5, wherein the synchronous control section is configured to transmit a command to the second device for driving the conveying roller at an earlier timing than the driving start of the conveying roller of the first device.

7. The card conveyance system according to claim 5, wherein the synchronous control section is configured to transmit commands for simultaneously driving the conveying roller of the first device and the conveying roller of the second device, and the command transmitted to the conveying roller of the first device comprises a delay time command which delays start of driving for a predetermined time.

8. The card conveyance system according to claim 1, wherein the middleware executing section is configured to control at least one of the first device and the second device by service of OS, and the synchronous control section is configured to transmit a command to at least the one of the first device and the second device controlled by the service through inter-process communication of OS.

9. The card conveyance system according to claim 8, wherein the synchronous control section is configured to drive the conveying roller of the second device at an equal or higher speed than the conveying roller of the first device.

10. The card conveyance system according to claim 9, wherein the synchronous control section is configured to start driving of the conveying roller of the second device before driving start of the conveying roller of the first device.

11. The card conveyance system according to claim 1, wherein the synchronous control section is configured to drive the conveying roller of the second device at an equal or higher speed than the conveying roller of the first device.

12. The card conveyance system according to claim 1, wherein the synchronous control section is configured to start driving of the conveying roller of the second device before driving start of the conveying roller of the first device.

13. The card conveyance system according to claim 1, wherein each of the first device and the second device is a card reader structured to contact with the card for reading and writing information, a non-contact IC card reader structured to read and write information in the card in a non-contact state, a card collection and return module structured to collect and return the card, an image reader structured to optically read the card, or a printer structured to print on the card.

* * * * *